US008882616B2

(12) United States Patent
Stein

(10) Patent No.: US 8,882,616 B2
(45) Date of Patent: Nov. 11, 2014

(54) RACKET AND A PROCESS THAT ALLOWS THE ENTIRE LENGTH OF THE RACKET HANDLE ACCESSIBLE TO RECEIVE INSERTABLE AND REMOVABLE CARTRIDGE CARRIERS OF VARIOUS WEIGHTS FOR PLAY TESTING AND RACKET CUSTOMIZATION

(76) Inventor: Edward Allen Stein, Smyrna, GA (US)

( * ) Notice: Subject to any disclaimer, the term of this patent is extended or adjusted under 35 U.S.C. 154(b) by 600 days.

(21) Appl. No.: 13/223,666

(22) Filed: Sep. 1, 2011

(65) Prior Publication Data

US 2012/0214624 A1 Aug. 23, 2012

Related U.S. Application Data

(60) Provisional application No. 61/463,844, filed on Feb. 23, 2011.

(51) Int. Cl.

| | |
|---|---|
| ***A63B 49/08*** | (2006.01) |
| ***A63B 49/04*** | (2006.01) |
| *A63B 53/14* | (2006.01) |
| *A63B 53/16* | (2006.01) |

(52) U.S. Cl.

CPC ..... *A63B 49/04* (2013.01); *A63B 49/08* (2013.01); *A63B 53/145* (2013.01); *A63B 53/16* (2013.01)

USPC ..... 473/519; 473/549

(58) Field of Classification Search

USPC ..... 473/519, 521, 549, 553

See application file for complete search history.

(56) References Cited

U.S. PATENT DOCUMENTS

| | | | | |
|---|---|---|---|---|
| 1,587,918 | A * | 6/1926 | Morrison | 473/519 |
| 2,004,609 | A * | 6/1935 | Johnston | 473/519 |
| 2,028,291 | A * | 1/1936 | MacPherson | 473/519 |
| 2,121,289 | A * | 6/1938 | Gleadall | 473/519 |
| 2,215,899 | A * | 9/1940 | Beasley | 473/519 |
| 4,984,793 | A * | 1/1991 | Chen | 473/519 |
| 5,034,082 | A * | 7/1991 | Nolan | 156/245 |
| 6,159,115 | A * | 12/2000 | Hsu | 473/549 |
| 6,254,502 | B1 * | 7/2001 | Becker | 473/594 |
| 6,461,259 | B1 * | 10/2002 | Li | 473/527 |
| 7,070,524 | B1 * | 7/2006 | Garvey, III | 473/519 |
| 7,198,581 | B1 * | 4/2007 | Black | 473/454 |
| 2004/0038762 | A1 | 2/2004 | Okamoto | |
| 2004/0053715 | A1 | 3/2004 | Schwieg et al. | |
| 2006/0063618 | A1 | 3/2006 | Okamoto | |

* cited by examiner

*Primary Examiner* — Raleigh W Chiu

(74) *Attorney, Agent, or Firm* — Withers & Keys, LLC

(57) ABSTRACT

Rackets and a process that allows up to the entire length of a racket handle to receive various weight carriers enabling for selective control of overall weight, distribution of weight, balance point, swing weight, racket customization, and equalization between rackets are disclosed.

24 Claims, 15 Drawing Sheets

RACKET AND A PROCESS THAT ALLOWS THE ENTIRE LENGTH OF THE RACKET HANDLE ACCESSIBLE TO RECEIVE INSERTABLE AND REMOVABLE CARTRIDGE CARRIERS OF VARIOUS WEIGHTS FOR PLAY TESTING AND RACKET CUSTOMIZATION

CROSS-REFERENCE TO RELATED APPLICATIONS

This patent application claims the benefit of priority to U.S. Provisional Patent Application Ser. No. 61/463,844 filed on Feb. 23, 2011 and entitled "PROCESS OF MAKING THE INTERNAL ASPECTS OF A RACKET HANDLE ACCESSIBLE TO RECEIVE AND PLAYTEST VARIOUS WEIGHTS," the subject matter of which is hereby incorporated by reference in its entirety.

FIELD OF THE INVENTION

The present invention relates to sport racket handles and rackets such as tennis rackets, squash rackets, badminton rackets and racquetball rackets, methods of making racket handles and rackets, and methods of using racket handles in rackets such as in a tennis racket.

BACKGROUND OF THE INVENTION

Rackets are described in terms of various specifications. Some specifications cannot be altered and are characteristic properties of the manufactured racket. These include, for example, frame stiffness and string bed density.

Frame stiffness is a measure of the resistance of the frame to bending upon impact. Stiffness is measured by a device that clamps the racket at the throat area, and physically bends the tip of the racket a standard deviation downward. See, for example, the device disclosed in U.S. Pat. No. 4,488,444). A higher measured value indicates greater frame stiffness.

String bed density is a function of the number of holes that enable strings to be placed through the side profile of the hitting area, and how close the string holes are placed together. The greater the number of holes and the closer the string holes are together, the greater the string bed density.

Other specifications that can be modified post racket production are overall weight, distribution of weight, balance point, and swing weight. The majority of rackets today are comprised of carbon fiber. Rackets found in stores and sold today are constructed to be superlight, and are made for the average tennis player. Rackets used by top competitive players are made heavier by the addition of lead tape at specific areas of the racket. The areas where additional weights are usually placed are on the string bed hoop (i.e., the oval shape) and inside the handle. Typically, additional weights are placed at locations along the hoop at the 12 o'clock position inside section of frame string bed area, the 3 o'clock position, and the 9 o'clock position. (See, for example, exemplary racket 100 shown in FIG. 1). The hoop areas of the frame are easily accessible and simple to modify by the addition of lead tape.

The addition of weight inside the handle of a racket is a difficult area to reach. Most weight added in this region is done by the manufacturer during construction of the frame. Even a small addition of weight, such as one gram, results in significant performance differences of the racket. These performance differences are so significant that top level professionals often spend up to two hundred U.S. dollars per frame to have their rackets and their custom measurements made exactly the same. This is necessary because there are always differences that exist from one machined racket to the next.

Furthermore, every racket has a balance point. There is one point on a frame that the racket will balance horizontally, or level like on a see-saw. Other than this finite point, the addition of weight to a racket will change the balance point. The addition of weight in the handle moves the balance point closer to the handle. The addition of weight on the head of the racket moves the balance point closer to the tip of the frame.

The swing weight of a racket is the sum of each atom's mass times the distance squared to the pivot point at 4.0 inches on the handle. The standard units of swing weight are kilograms times meters squared. Swing weight is measured by a machine that clamps the racket at 4.0 inches and circumferentially swings the racket on one level plane. (See again, for example, the machine disclosed in U.S. Pat. No. 4,488,444). The higher the swing weight value, the more weight the human hand perceives and the heavier the racket feels. The addition of weight at greater than 4.0 inches from the handle end of the racket increases swing weight. By definition, the addition of weight in the lower 4.0 inches of the racket handle has no effect on swing weight. The addition of weight in the handle, especially the terminal four inches, although inaccessible in current rackets, is of paramount importance in the playing characteristics of the racket.

What is needed in the art is a simple method of altering the weight of a racket along the entire length of the racket handle.

SUMMARY OF THE INVENTION

The present invention is directed to a racket and a process to make the entire length of a racket handle accessible to receive cartridges or carriers of various weights. The disclosed method allows a player to play test variations of handle weights using one racket, rather than having the manufacturer make multiple rackets.

According to one exemplary embodiment of the present invention, the present invention is directed to a racket comprising a racket handle having a first grip butt end, a second handle connecting end opposite the first grip butt end, and one or more side surfaces extending between and connecting the first grip butt and second handle connecting ends; and one or more accessible slots extending from the first grip butt end into the racket handle toward the second handle connecting end, each accessible slot (i) being sized and dimensioned so as to receive one or more removable weights, and (ii) having a slot length of up to a full length of the racket handle.

In another exemplary embodiment of the present invention, the disclosed racket comprises a racket handle having a first grip butt end, a second handle connecting end opposite the first grip butt end, and one or more side surfaces extending between and connecting the first grip butt and second handle connecting ends; one or more accessible slots extending from the first grip butt end into the racket handle toward the second handle connecting end, each accessible slot (i) being sized and dimensioned so as to receive one or more removable weights, and (ii) having a slot length that extends at least 50% of a total distance between the first grip butt end and the second handle connecting end; a head; and a throat connecting (i) the second handle connecting end of the racket handle and (ii) the head.

In yet another exemplary embodiment of the present invention, the disclosed racket comprises a racket handle having a first grip butt end, a second handle connecting end opposite the first grip butt end, and one or more side surfaces extending between and connecting the first grip butt and second handle connecting ends; one or more accessible slots extending from the first grip butt end into the racket handle toward the second handle connecting end, each accessible slot (i) being sized and dimensioned so as to receive one or more removable weights, and (ii) having a slot length that extends at least 50% of a total distance between the first grip butt end and the second handle connecting end; a single first end cover member sized to prevent one or more removable weights, when present within the one or more accessible slots, from exiting the one or more accessible slots; a handle pallet positioned over and attached to at least a portion of the one or more side surfaces, the handle pallet comprising a single tubular piece or two or more tubular pieces that extend(s) around an outer perimeter of said racket handle; a leather or synthetic grip material positioned over at least a portion of an outer surface of the handle pallet; a head; and a throat connecting (i) the second handle connecting end of the racket handle and (ii) the head.

The present invention is further directed to (1) racket handles and/or rackets in combination with (2) one or more removable weights. In one exemplary embodiment, the combination of (1) racket handles and/or rackets and (2) one or more removable weights comprises (a) a racket handle having a first grip butt end, a second handle connecting end opposite the first grip butt end, and one or more side surfaces extending between and connecting the first grip butt and second handle connecting ends; and one or more accessible slots extending from the first grip butt end into the racket handle toward the second handle connecting end, each accessible slot (i) being sized and dimensioned so as to receive one or more removable weights, and (ii) having a slot length of up to a full length of the racket handle; and (b) one or more removable weights, wherein each of the one or more removable weights (i) comprises a carrier and one or more individual weights positioned along the carrier, (ii) is sized and dimensioned so as to securely fit within and extend along a given accessible slot, and (iii) has a removable weight length less than, substantially equal to, or slightly greater than the slot length.

The present invention is even further directed to methods of making racket handles and rackets. In one exemplary embodiment, the method of making a racket comprises forming a racket handle having (i) a first grip butt end, (ii) a second handle connecting end opposite the first grip butt end, (iii) one or more side surfaces extending between and connecting the first grip butt and second handle connecting ends, and (iv) one or more accessible slots extending from the first grip butt end into the racket handle toward the second handle connecting end, each accessible slot being sized and dimensioned so as to receive one or more removable weights, and having a slot length of up to a full length of the racket handle.

The method of making a racket may further comprise one or more additional steps including, but not limited to, forming a frame comprising the racket handle, a head and a throat connecting the racket handle and head; forming a foam pallet (e.g., a two piece polyurethane foam pallet); attaching a foam pallet (e.g., a two piece polyurethane foam pallet) over at least a portion of the racket handle; attaching a butt end cap with access window to a first grip butt end of the racket handle; forming a first end cover member; attaching the first end cover member to the butt end cap so as to fit within the access window; forming a leather or synthetic grip over the foam pallet; forming one or more removable weights; forming one or more removable weights, wherein each of the one or more removable weights comprises a carrier having one or more weights positioned thereon; removing the first end cover member from the butt end cap so as to access the access window; and inserting one or more removable weights within the one or more accessible slots of the racket handle.

The present invention is even further directed to methods of using the disclosed racket handles and rackets. In one exemplary embodiment, the method of using a racket comprises a method of changing (i) a weight, (ii) a weight distribution, or (iii) both (i) and (ii) of the racket, wherein the method comprises removing one or more first removable weights, if present, from one or more accessible slots of a racket handle; and inserting one or more second removable weights into the one or more accessible slots of the racket handle, wherein the one or more second removable weights differ from the one or more first removable weights in at least one of (i) total weight, and (ii) weight distribution along the racket handle.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

The present invention is directed to rackets and racket handles that enable a user to adjust (i) an overall weight, (ii) a weight distribution, or (iii) both (i) and (ii) of a racket or racket handle via one or more accessible slots that extend up to a full length of the racket handle. As discussed below, typically, the one or more accessible slots that extend at least 50% (or at least 60%, or at least 70%, or at least 80%, or at least 90%, or 100%) of a full length of the racket handle. The present invention is further directed to (1) racket handles and/or rackets in combination with (2) one or more removable weights, wherein the one or more removable weights are sized and dimensioned to fit within the one or more accessible slots of the racket handle. The present invention is even further directed to methods of making and using the disclosed racket handles, rackets and one or more removable weights (also referred to herein as "one or more removable cartridges").

Figure 1:
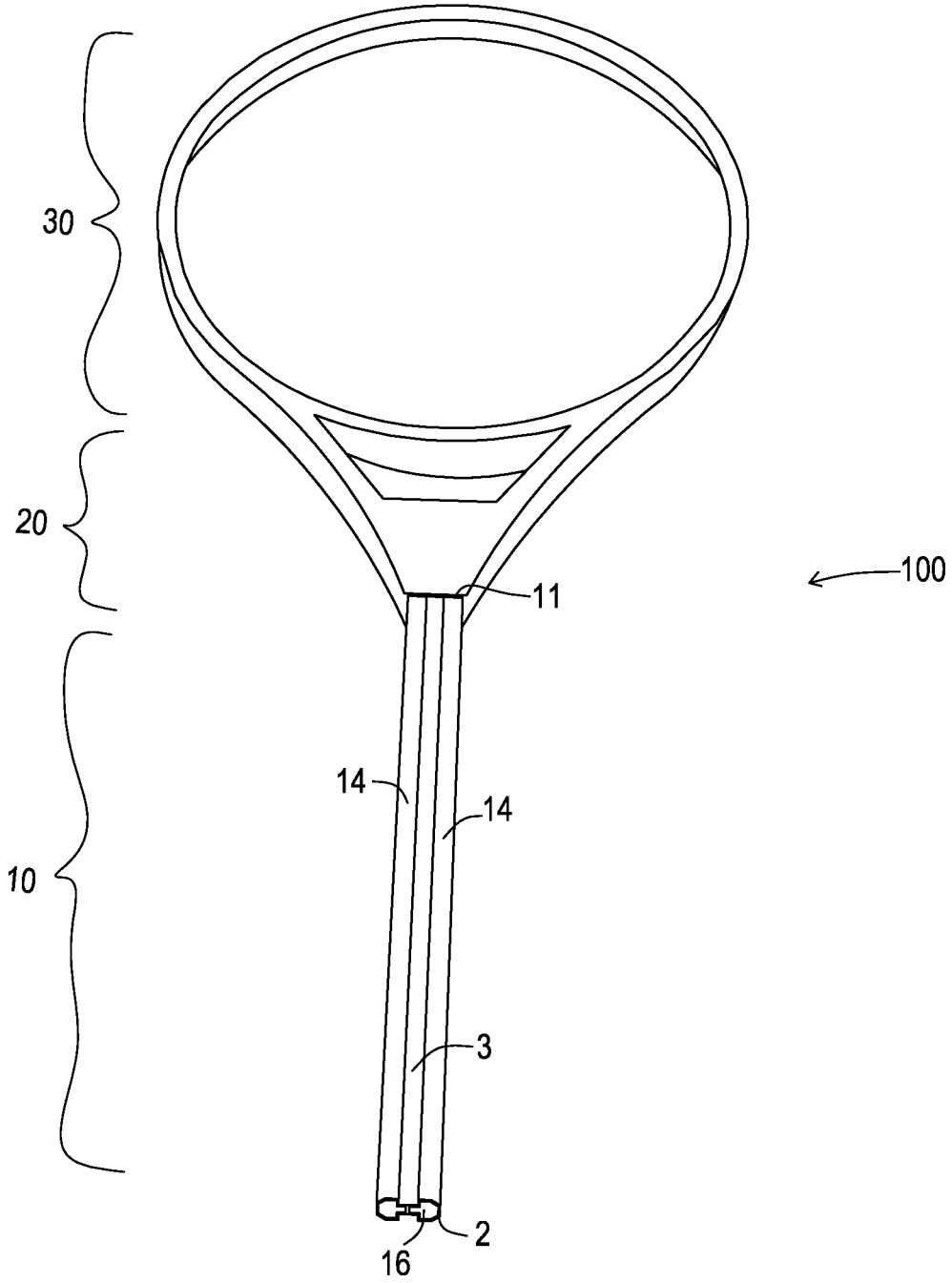
FIG. 1 displays an exemplary racket of the present invention.

FIG. 1 displays an exemplary racket of the present invention. As shown in FIG. 1, exemplary racket 100 comprises exemplary handle 10, exemplary head 30 and exemplary throat 20 connecting exemplary handle 10 to exemplary head 30. Exemplary handle 10 has a first grip butt end 2, a second handle connecting end 11 opposite exemplary first grip butt end 2, and one or more side surfaces 14 extending between and connecting first grip butt end 2 and second handle connecting end 11. Second handle connecting end 11 connects to throat 20, which connects to head 30. It should be understood that, in some embodiments of the present invention, second handle connecting end 11 of handle 10 may connect directly to head 30 or second handle connecting end 11 of handle 10 may connect to head 30 via a throat 20, wherein throat 20 essentially represents a connector between second handle connecting end 11 of handle 10 and head 30 (i.e., throat 20 represents a relatively minor portion of an overall length of racket 100).

Figure 2:
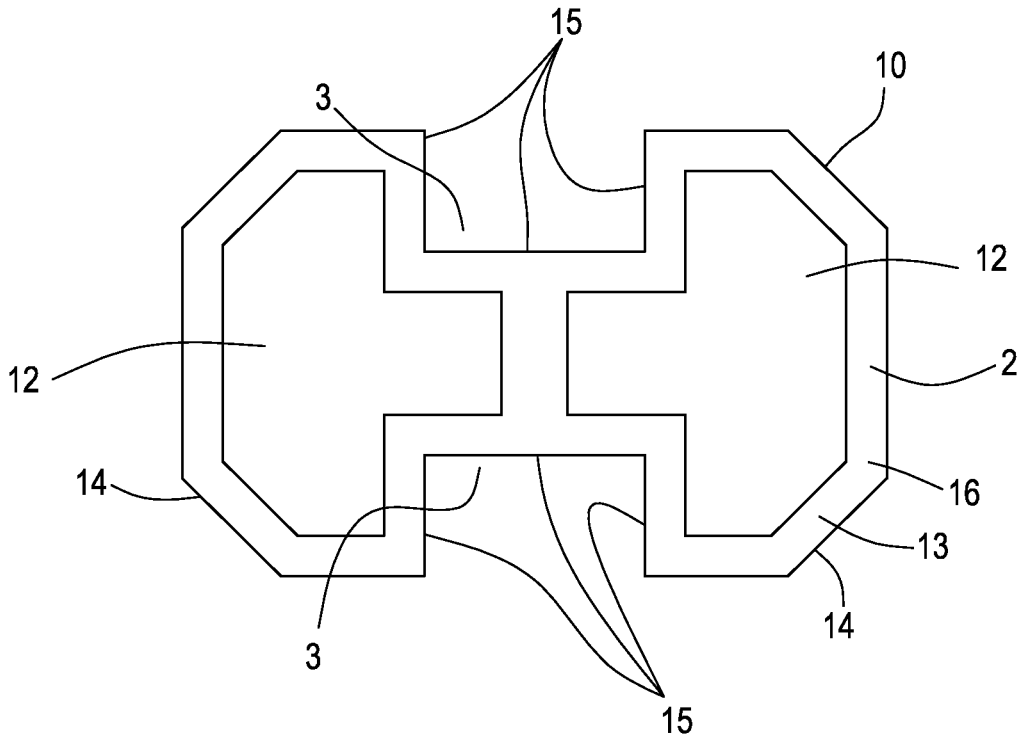
FIG. 2 displays an exemplary first grip butt end of the exemplary racket shown in FIG. 1.

FIG. 2 displays an exemplary first grip butt end 2 of exemplary racket 100 shown in FIG. 1. As shown in FIG. 2, exemplary handle 10 comprises first grip butt end 2 having exemplary accessible slots 3 extending from first grip butt end 2 into racket handle 10 toward second handle connecting end 11 (see also, FIGS. 1 and 3). As discussed further below, each accessible slot 3 (i) is sized and dimensioned so as to receive one or more removable weights (shown in FIGS. 6-7 and 10), and (ii) has a slot length of up to a full length of racket handle 10.

As shown in FIG. 2, exemplary handle 10 may comprise a handle structure 13 that provides one or more accessible slots 3 formed therein. In this exemplary embodiment, exemplary handle structure 13 provides two accessible slots 3 positioned opposite one another along first end surface 16 of first grip butt end 2. Each accessible slot 3 comprises slot side surfaces 15, which extend a full length of each accessible slot 3. Exemplary handle structure 13 further comprises hollow sections 12 extending up to a full length of racket handle 10. Hollow sections 12 found throughout the tubular carbon fiber racket may be left hollow or sometimes may be filled with a polymeric foam material such as polyurethane foam, or other media such as silicon during the manufacturing process.

Figure 3:
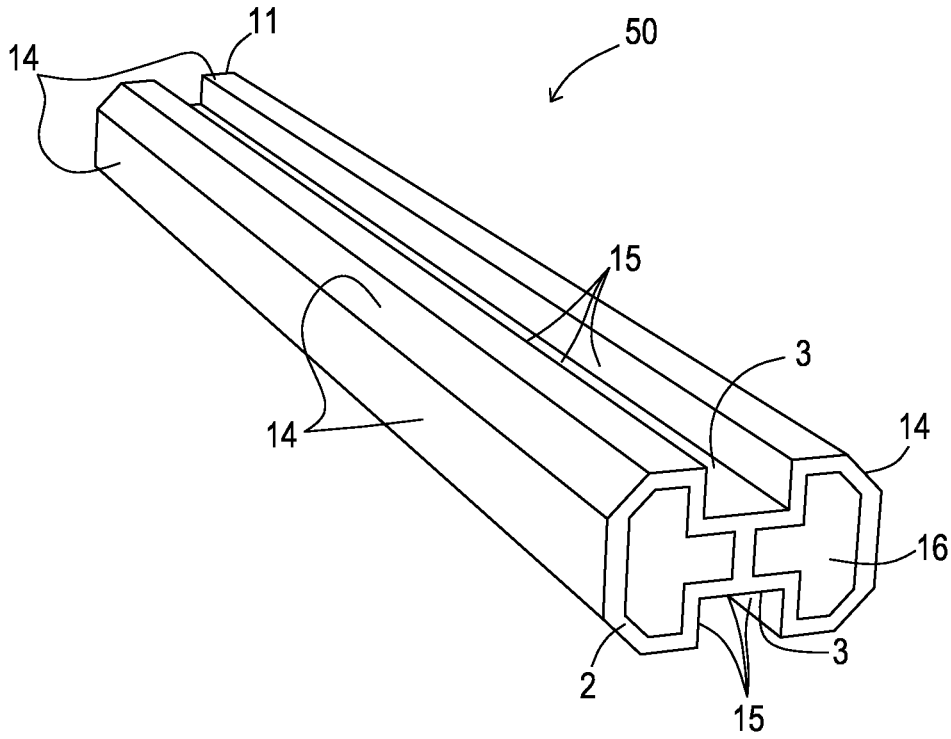
FIG. 3 displays another exemplary handle with exemplary slots positioned therein.

FIG. 3 displays another exemplary handle with exemplary slots positioned therein. As shown in FIG. 3, exemplary handle 50 comprises first grip butt end 2 having exemplary accessible slots 3 extending from first grip butt end 2 into racket handle 50 toward second handle connecting end 11. Exemplary handle 50 further comprises one or more side surfaces 14 extending between and connecting first grip butt end 2 and second handle connecting end 11; slot side surfaces 15 extending a full length of each accessible slot 3; and first end surface 16 of first grip butt end 2.

Figure 4:
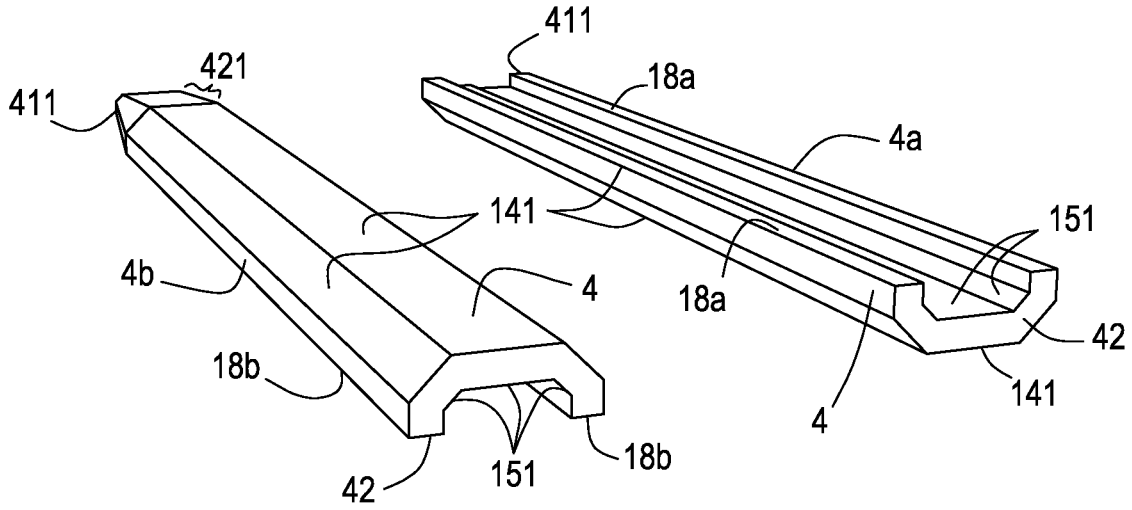
FIG. 4 displays an exemplary two piece foam handle section (also referred to herein as a "handle pallet") suitable for use with the exemplary handles shown in FIGS. 1-3.

FIG. 4 displays exemplary two piece foam handle section or exemplary handle pallet 4 suitable for use with either of exemplary handles 10 and 50 shown in FIGS. 1-3. As shown in FIG. 4, exemplary handle pallet 4 comprises pallet half portions 4*a* and 4*b*, each of which has a first pallet butt end 42, a second pallet throat end 411, one or more outer side surfaces 141 extending between and connecting first pallet butt end 42 and second pallet throat end 411; and one or more inner side surfaces 151 extending between and connecting first pallet butt end 42 and second pallet throat end 411. Exemplary handle pallet 4 further comprises a tapered end section 421 at second pallet throat end 411 so as to provide a smooth transition from one or more outer side surfaces 141 of pallet half portions 4*a* and 4*b* to an outer surface of a throat portion (e.g., throat 20 shown in FIG. 1) of a given racket.

As shown in FIG. 4, each of exemplary pallet half portions 4*a* and 4*b* independently comprises connecting edges 18*a* and 18*b* respectively, which desirably abut one another when positioned over an exemplary handle such as either of exemplary handles 10 and 50. Such an assembled configuration is shown in FIG. 5.

Figure 5:
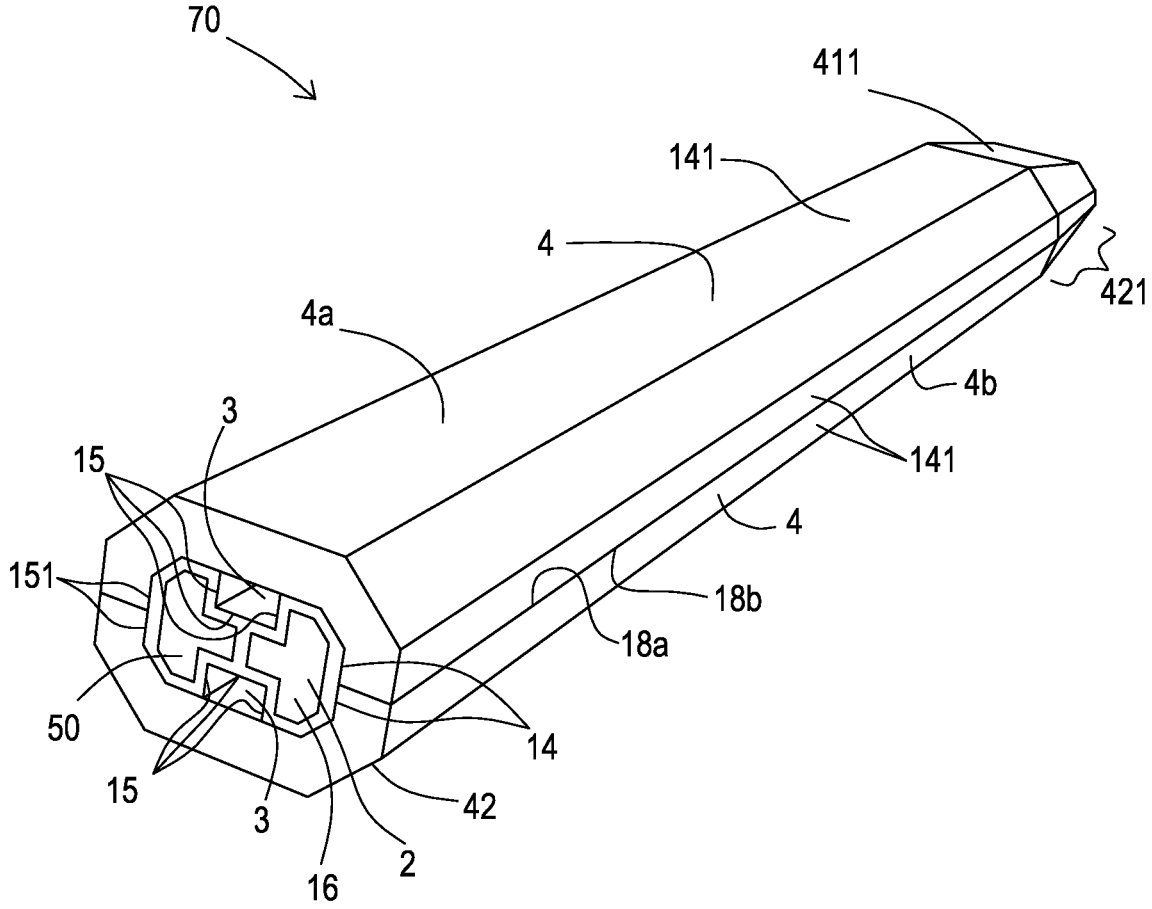
FIG. 5 displays the exemplary foam handle halves of FIG. 4 attached to the exemplary handle shown in FIG. 3.

FIG. 5 displays exemplary pallet half portions 4*a* and 4*b* of FIG. 4 positioned over and attached to exemplary handle 50 shown in FIG. 3 so as to form an exemplary handle 50/pallet 4 combination referred to below as exemplary handle/pallet combination 70. As shown in FIG. 5, with exemplary pallet half portions 4*a* and 4*b* of FIG. 4 positioned over and attached to exemplary handle 50, one or more accessible slots 3 are accessible from first end surface 16 positioned along first grip butt end 2 of exemplary handle 50.

It should be noted that exemplary pallet half portions 4*a* and 4*b* may be attached to a racket handle, such as exemplary handle 50, via any known attachment device. Suitable attachment devices include, but are not limited to, adhesive, double-sided tape, mechanical fasteners (e.g., staples, etc.), etc. Once attached, exemplary pallet half portions 4*a* and 4*b* provide an outermost surface formed by outer side surfaces 141 of both exemplary pallet half portions 4*a* and 4*b* as shown in FIG. 5. Moreover, once attached, each of one or more accessible slots 3 are bound by (i) slot side surfaces 15 and (ii) at least one inner side surface 151 of either pallet half portion 4*a* or 4*b* as shown in FIG. 5.

It should be further noted that in other embodiments of the present invention (not shown), one or more accessible slots 3 may be bound solely by slot side surfaces 15 such as when the one or more accessible slots 3 are drilled into an inner portion of a given exemplary handle (i.e., the one or more accessible slots 3 do not form any portion of an outer surface of the handle).

As shown in FIGS. 4-5, handle pallet 4 may comprise two or more tubular pieces (e.g., pallet portions 4*a* and 4*b*) that extend around an outer perimeter of a given racket handle (e.g., racket handle 50). In other embodiments (not shown), handle pallet 4 may comprise a single tubular piece that extends around an outer perimeter of a given racket handle (e.g., racket handle 50). Regardless of the configuration, handle pallet 4 may be formed from a variety of materials. Suitable materials for forming handle pallet 4 include, but are not limited to, a polymeric foam, a composite material (e.g., fiber reinforced thermoplastic or thermoset material), carbon fiber, etc. In one desired embodiment, handle pallet 4 is formed from a polyurethane foam.

In addition, it should be understood that in other embodiments of the present invention (not shown), the handle (e.g., handle 10 or 50) may be configured such that pallet 4 is unnecessary, and the handle itself forms an outer surface encompassing one or more accessible slots 3. In other words, the handle can be constructed from one or more of the above-mentioned materials (e.g., carbon fiber or composite material) so as to have a construction similar to exemplary handle/pallet combination 70 shown in FIG. 5.

Figure 6:
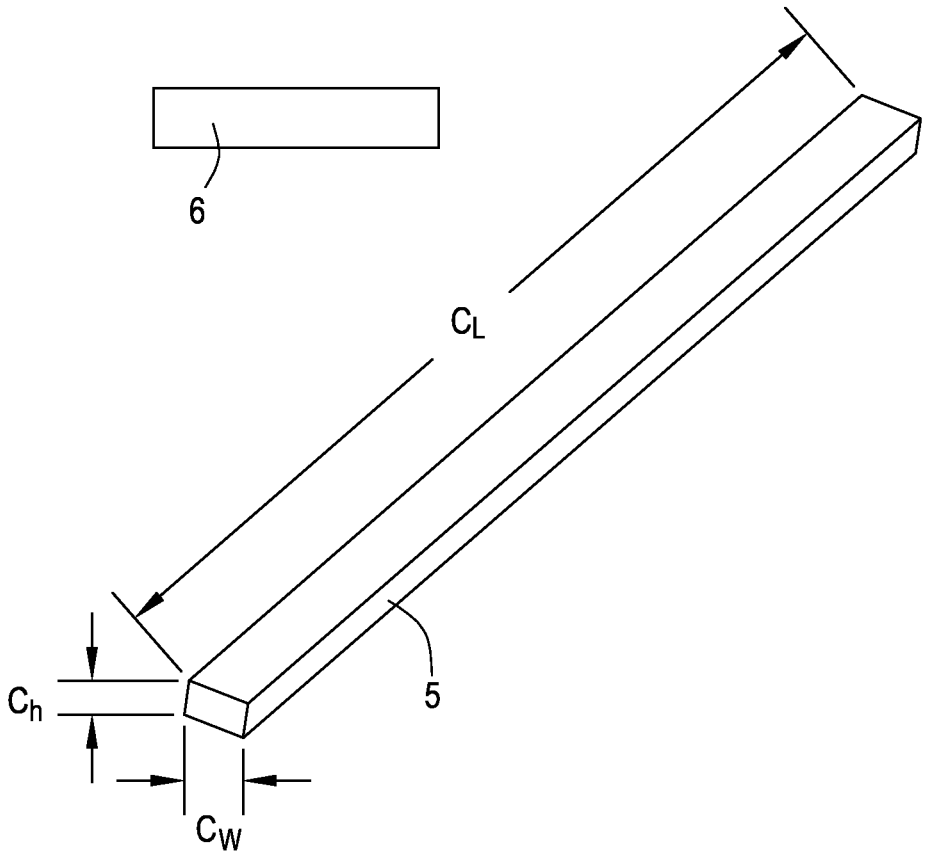
FIG. 6 displays an exemplary carrier and exemplary weight suitable for use with the exemplary handles shown in FIGS. 1-5.

FIG. 6 displays an exemplary carrier and exemplary weight suitable for use with exemplary handles 10 and 50 shown in FIGS. 1-5. As shown in FIG. 6, exemplary carrier 5 is configured to have a carrier length $C_L$, a carrier width $C_w$, and a carrier height $C_h$ so as to desirably enable a secure fit within a given accessible slot 3. Exemplary carrier 5 and exemplary weight 6 act collectively as an insertable and removable cartridge 56 for a given accessible slot 3. A "secure" fit is used to describe a position of a given carrier 5 within a given accessible slot 3 so that carrier 5 (i) contacts one or more (desirably two or more) of slot side surfaces 15 and/or inner side surface 151 of either pallet half portion 4*a* or 4*b*, and (ii) remains substantially stationary within the given accessible slot 3 when a first end cover member is in place. Carrier 5 has one or more weights such as exemplary weight 6 positioned along carrier length $C_L$.

Figure 7:
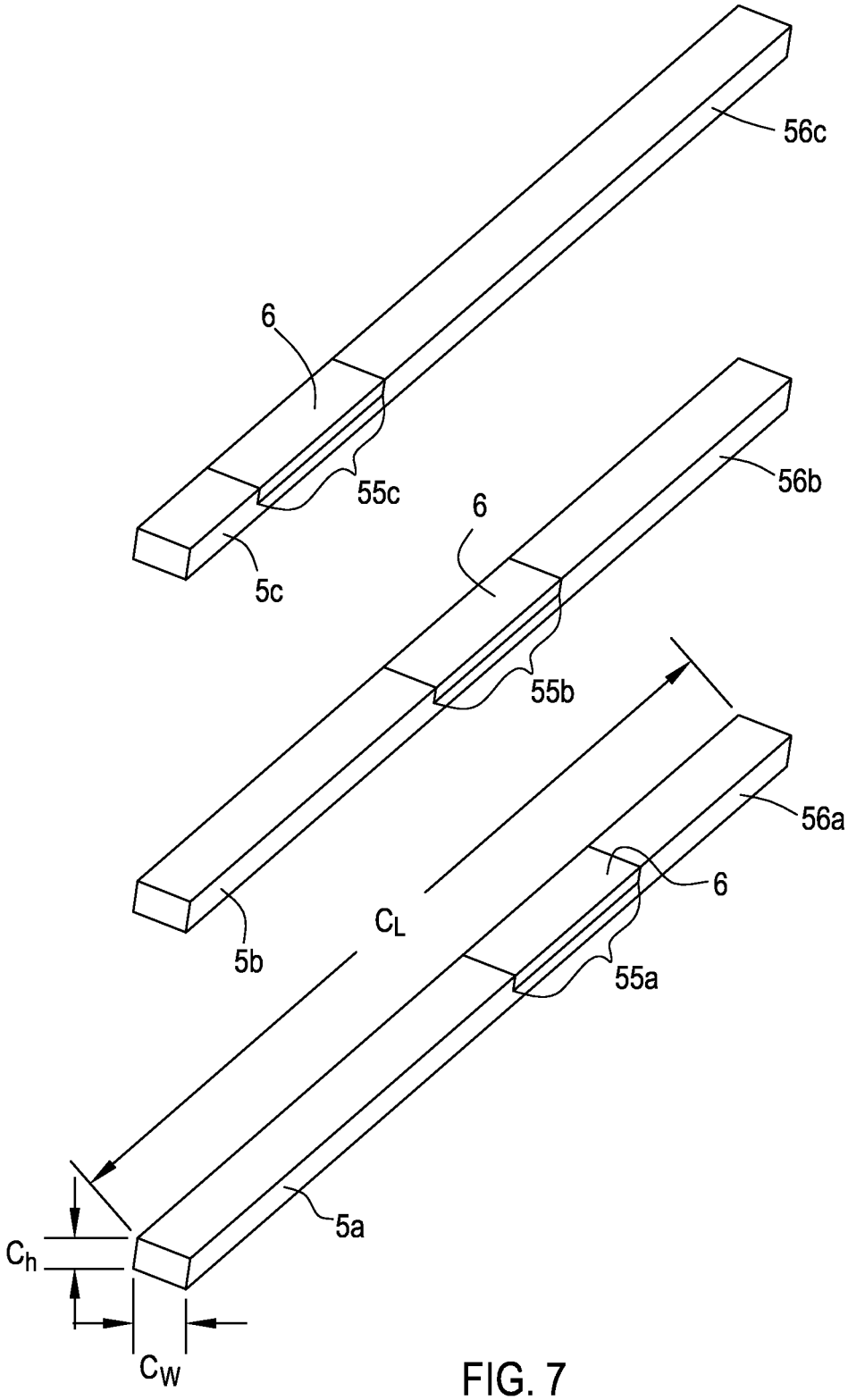
FIG. 7 displays three exemplary carriers of similar length where an exemplary weight is affixed at different location along the carrier.

FIG. 7 displays three exemplary carriers 5*a*, 5*b* and 5*c* having similar carrier length $C_L$, carrier width $C_w$, and carrier height $C_h$ with exemplary weight 6 is affixed at different locations along exemplary carriers 5*a*, 5*b* and 5*c*. As shown in FIG. 7, each of exemplary carriers 5*a*, 5*b* and 5*c* has a cut-out section 55*a*, 55*b* and 55*c* sized to receive exemplary weight 6.

It should be understood that each of exemplary weights 6 shown in FIGS. 6-7 may be permanently or temporarily attached to a given carrier 5 via any attachment device including, but not limited to, cement, adhesive tape, or double sided tape. Further, although not shown in FIGS. 6-7, each individual carrier (e.g., exemplary carrier 5*a*) and/or each individual weight (e.g., exemplary weight 6) may be configured so as to provide a gripping end portion operatively adapted to be gripped by, for example, needle nose pliers, so as to remove a given removable weight (e.g., insertable and removable cartridge 56 comprising carrier 5 and weight 6) from a given accessible slot 3 (see, discussion below with regard to FIGS. 12*a*-12*d*).

Although each of exemplary carriers 5*a*, 5*b* and 5*c* are shown in combination with exemplary weight 6, it should be understood that (1) a given carrier 5 may be configured to accept one or more various weights within one or more cut-out sections (i.e., such as exemplary cut-out section 55*a*) along carrier length $C_L$, and (2) a set of two of more carriers 5 (i.e., such as set of exemplary carriers 5*a*, 5*b* and 5*c* shown in FIG. 7) may be configured to accept a single weight within a cut-out section (i.e., such as exemplary cut-out section 55*a*) along carrier length $C_L$, wherein (i) the weight, (ii) the location of the weight, or (iii) both (i) and (ii) differs from one carrier 5 (i.e., such as exemplary carriers 5*a*) to another carrier 5 (i.e., such as exemplary carriers 5*b*) within the set.

Exemplary carrier 5 and exemplary weight 6 may be formed from any material, but typically, exemplary carrier 5 comprises a carrier material having a carrier basis weight, and each of the one or more individual weights (e.g., exemplary weight 6) comprises a weight material having a higher basis weight than the carrier basis weight. Suitable carrier materials include, but are not limited to, wood, such as balsa wood, basswood, a polymeric material, a foam material, a metal material, such as aluminum, steel, or a combination of materials in a single layer or in bilayers or trilayers of similar or different materials, etc. Suitable weight materials include, but are not limited to, lead shapes, lead tape, encapsulated lead powder, etc. In one desired embodiment, the carrier material (e.g., exemplary carrier 5) comprises basswood, and each of the one or more individual weights (e.g., exemplary weight 6) comprises lead or lead tape.

In some embodiments, an absorptive intermediary material (not shown) may be used to circumscribe the carrier weight system prior to inserting a given removable weight (e.g., insertable and removable cartridge 56) within a given accessible slot 3. Suitable absorptive intermediary materials include, but are not limited to, fabric, felt, cotton, or shrink wrap. In other embodiments, the intermediary material may be directly attached to the carbon fiber, polyurethane foam, or both of handle structure 13 by adhesive means (i.e., the intermediary material may line one or more side surfaces of a given accessible slot 3 of handle structure 13).

Although each of exemplary carriers 5*a*, 5*b* and 5*c* (and each of accessible slot 3) are shown as having a rectangular cross-sectional area configuration, a given in combination with exemplary weight 6, it should be understood that (1) a given carrier 5 (and a given accessible slot 3) may have any desired cross-sectional area configuration. Suitable cross-sectional area configurations include, but are not limited to, a square cross-sectional area configuration, an oval cross-sectional area configuration, a star-shaped cross-sectional area configuration, a triangular cross-sectional area configuration, a circular cross-sectional area configuration, a hexagonal cross-sectional area configuration, or any other cross-sectional area configuration.

Figure 8:
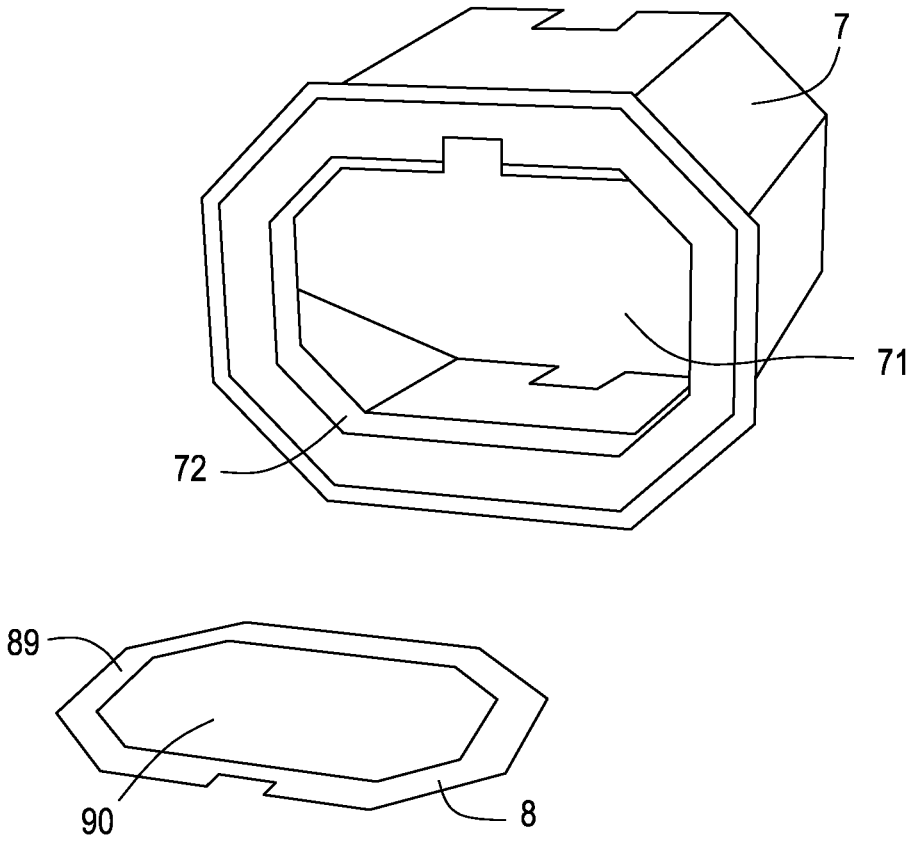
FIG. 8 displays an exemplary butt cap having an open window and a window cap that can snap on the exemplary butt cap to close the open window, which provides access to one or more accessible slots extending along a length of a given handle.

As shown in FIG. 8, handles and rackets of the present invention may further comprise at least one first end cover member sized to prevent one or more removable weights 56 (e.g., a carrier/weight combination such as removable weights 56*a*, 56*b* and 56*c* (e.g., insertable and removable cartridges 56*a*, 56*b* and 56*c*) shown in FIG. 7), when present within one or more accessible slots 3, from exiting one or more accessible slots 3. Typically, the at least one first end cover member comprises a single first end cover member sized to prevent one or more removable weights 56, when present within one or more accessible slots 3, from exiting one or more accessible slots 3. An exemplary first end cover member is shown in FIG. 8.

FIG. 8 displays an exemplary butt cap 7 having an open window 71 and a window cap 8 that can snap on exemplary butt cap 7 along butt cap surface 72 to close open window 71. Open window 71 is sized and dimensioned to provide access to one or more accessible slots 3 extending along a length of a given handle (e.g., handle 50 shown in FIG. 3) when positioned on a given handle (e.g., handle 50 shown in FIG. 3).

Figure 9:
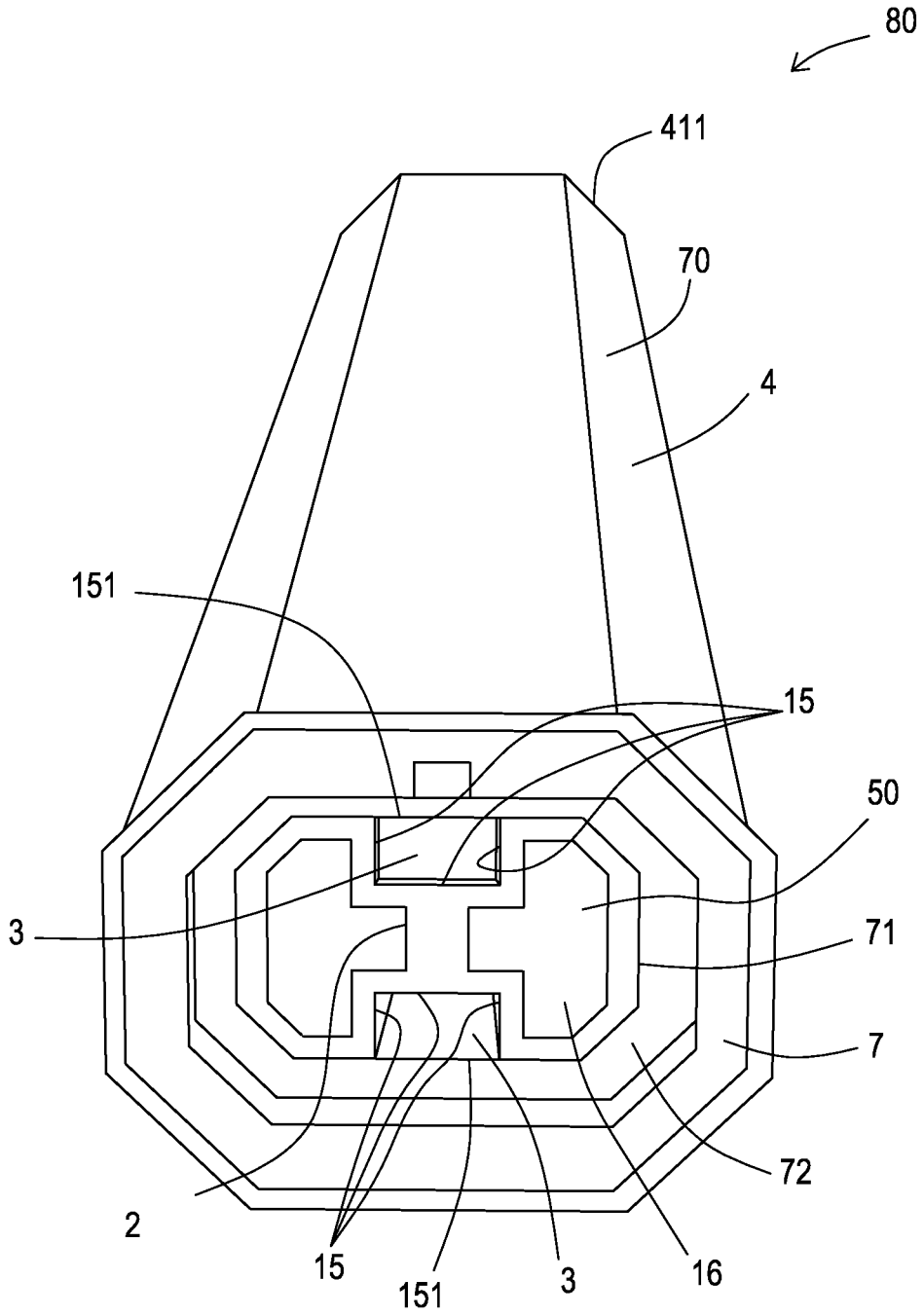
FIG. 9 displays the exemplary butt cap of FIG. 8 affixed to the exemplary handle of FIG. 5.

FIG. 9 displays exemplary butt cap 7 of FIG. 8 affixed to exemplary handle/pallet combination 70 of FIG. 5. As shown in FIG. 9, exemplary butt cap 7 desirably fits over a portion of first pallet butt end 42 of exemplary handle/pallet combination 70 so that open window 71 of exemplary butt cap 7 can provide access to accessible slots 3 of exemplary handle 50 within exemplary handle/pallet combination 70. The resulting exemplary handle is referred to herein as exemplary handle 80.

Figure 10:
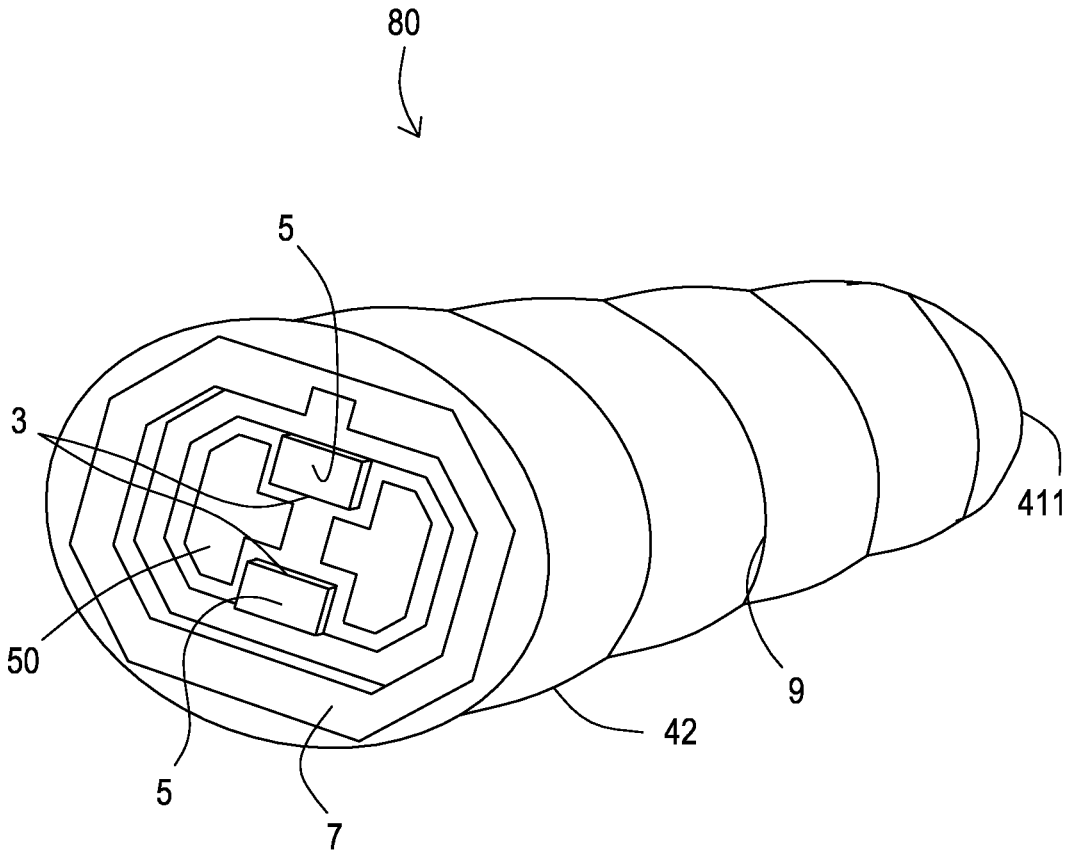
FIG. 10 displays the exemplary handle of FIG. 9 with exemplary weight carriers inserted into exemplary accessible slots of the handle and a leather or synthetic grip attached to the exemplary handle pallets thereof.

FIG. 10 displays exemplary handle 80 of FIG. 9 with exemplary weight carriers 5 inserted into exemplary accessible slots 3 of exemplary handle 50 and a leather or synthetic grip 9 attached to and surrounding at least a portion of outer surfaces 141 of exemplary handle pallet 4. The design of exemplary butt cap 7, butt cap window 71, and butt cap cover 8 allow space for the exemplary weight carriers (e.g., one or more of removable weights 56*a*, 56*b* and 56*c*) to extend approximately ⅛ of an inch beyond the terminus of the carbon fiber frame (i.e., beyond first grip butt end 2). To dislodge the weight carrier 5, needle nose pliers may be used to grab carrier 5, and remove a given cartridge system 56 (see, for example, FIGS. 12*a*-12*d* below). Typically, leather or synthetic grip 9 attaches to and surrounds a majority (or, in some embodiments, all) of outer surfaces 141 of exemplary handle pallet 4 extending from exemplary butt cap 7 to at least a beginning of tapered end section 421 of exemplary handle pallet 4.

Figure 11:
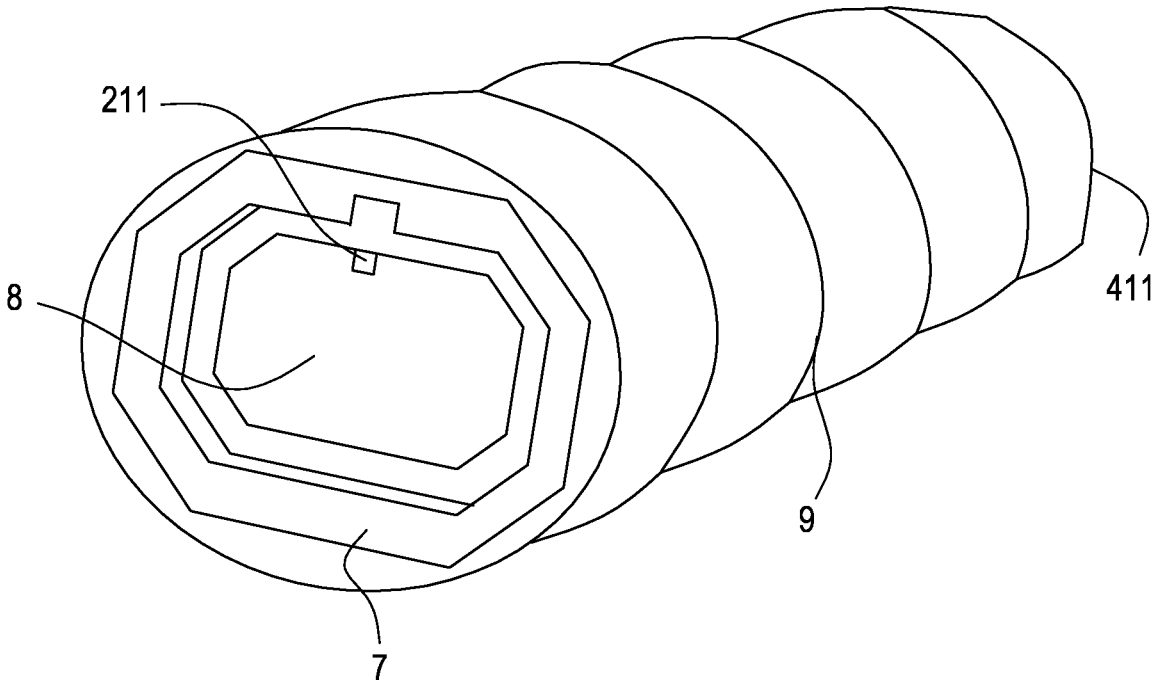
FIG. 11 displays the exemplary handle of FIG. 10 with a window cap attached to the butt cap to maintain a closed compartment.

FIG. 11 displays exemplary handle of FIG. 10 with window cap 8 attached to butt cap 7 to maintain a closed compartment (i.e., to secure one or more removable weights 56 within one or more accessible slots 3 of handle 50). It should be understood that window cap 8 may be attached to butt cap 7 via any desirable method. For example, window cap 8 may temporarily snap onto butt cap 7 or be permanently attached to butt cap 7 via, for example, a hinge element. In addition, an absorptive intermediary material, such as one of those discussed above, may be attached to an inner surface 89 of window cap 8 (see, for example, absorptive intermediary material 90 in FIG. 8) so as to provide an absorptive cushion between a given removable weight 56 and window cap 8.

As discussed above, the present invention is also directed to (1) any of the above-described racket handles (e.g., exemplary handles 10 or 50 shown in FIGS. 1-3) and/or rackets (e.g., exemplary racket 100 shown in FIG. 1) in combination with (2) one or more removable weights (e.g., exemplary removable weight 56 shown in FIG. 7). The combination of (1) racket handles and/or rackets (e.g., exemplary handles 10 or 50 shown in FIGS. 1-3 and exemplary racket 100 shown in FIG. 1) and (2) one or more removable weights (e.g., exemplary removable weight 56 shown in FIG. 7) may comprise (a) any of the herein-described racket handles and/or rackets; and (b) any of the herein-described removable weights. Desirably, each of the one or more removable weights (e.g., exemplary removable weight 56 shown in FIG. 7) (i) comprises a carrier (e.g., carrier 5) and one or more individual weights (e.g., exemplary weight 6) positioned along the carrier, (ii) is sized and dimensioned so as to securely fit within and extend along a given accessible slot 3, and (iii) has a removable weight length less than, substantially equal to, or slightly greater than the slot length (e.g., in some cases, about ⅛ inch greater than the slot length). The one or more removable weights may be separate from the racket handle and/or racket, or may be positioned within the racket handle and/or racket. Further, the one or more removable weights may form a set or kit comprising two or more removable weights, wherein each removable weight has (i) a different weight, (ii) a different weight distribution along a carrier of the removable weight, or (iii) both (i) and (ii).

The present invention is even further directed to methods of making racket handles, rackets, and removable weights suitable for use with the handles and rackets. In one exemplary embodiment, the method of making a racket comprises forming a racket handle having (i) a first grip butt end, (ii) a second handle connecting end opposite the first grip butt end, (iii) one or more side surfaces extending between and connecting the first grip butt and second handle connecting ends, and (iv) one or more accessible slots extending from the first grip butt end into the racket handle toward the second handle connecting end, each accessible slot being sized and dimensioned so as to receive one or more removable weights, and having a slot length of up to a full length of the racket handle.

The method of making a racket may further comprise one or more additional steps including, but not limited to, forming a frame comprising the racket handle, a head and a throat connecting the racket handle and head; forming a racket handle having one or more accessible slots extending up to a full length of the racket handle, wherein an outer surface of the racket handle surrounds each of the one or more accessible slots (e.g., a pallet is not necessary); forming a foam pallet (e.g., a two piece polyurethane foam pallet); attaching a foam pallet (e.g., a two piece polyurethane foam pallet) over at least a portion of the racket handle; attaching a butt end cap with access window to a first grip butt end of the racket handle; forming a foam pallet (e.g., a two piece polyurethane foam pallet) having integrally connected thereto a butt end cap with access window (i.e., the pallet and butt end cap are integrally attached to one another); forming a first end cover member; attaching the first end cover member to the butt end cap so as to fit within the access window; forming a leather or synthetic grip over the foam pallet; forming one or more removable weights; forming one or more removable weights, wherein each of the one or more removable weights comprises a carrier having one or more weights positioned thereon; removing the first end cover member from the butt end cap so as to access the access window; and inserting one or more removable weights within the one or more accessible slots of the racket handle.

In one exemplary embodiment, the method of making a racket comprises one or more of the following steps: forming a graphite handle (e.g., exemplary handle 10 or 50) manufactured with one or more accessible slots 3 that allow space for one or more weighted carriers to slide therein; forming a two piece polyurethane foam pallet that attaches to the graphite handle so that the foam pallet does not infringe on the space created by the handle slots; attaching the foam pallet to the graphite handle by double sided adhesive tape; forming a butt cap with access window and cementing the butt cap to the foam pallet/handle, the access window being used to allow a player to insert and exit different weight carriers; forming a leather or synthetic grip atop the foam pallet/handle; forming one or more rectangular, U-shaped or I shaped carriers that carry additional weight (usually lead) to the slotted space in the handle; forming multiple carriers having different weights and/or weight distributions so that different weights/weight distributions can be tested by a player during one hitting session; attaching one or more pallets directly to the racket handle by affixing double sided tape to the racket handle without adding tape to the slotted spaces; attaching an end cap to the pallet with cement while maintaining the slotted spaces; attaching a grip with double sided tape to the pallet; reducing the carrier (e.g., basswood) at one or more specific locations of the carrier to accept one or more weights (e.g., lead tape); sliding the weight carriers through the open end cap into the slotted handle spaces by utilizing a secure fit; and attaching the end cap cover to the end cap by utilizing a snap fit.

The present invention is even further directed to methods of using the disclosed racket handles and rackets. In one exemplary embodiment, the method of using a racket comprises a method of changing (i) a weight, (ii) a weight distribution, or (iii) both (i) and (ii) of the racket, wherein the method comprises removing one or more first removable weights, if present, from one or more accessible slots of a racket handle; and inserting one or more second removable weights into the one or more accessible slots of the racket handle, wherein the one or more second removable weights differ from the one or more first removable weights in at least one of (i) total weight, and (ii) weight distribution along the racket handle.

A method of removing weight from a handle of a racket may comprise: removing the end cap cover by inserting a micro flat head screwdriver into an open rectangular space of the end cap cover, and pushing the end cap cover in a direction away from the racket for cap release; exiting the weight carrier from the slotted handle; inserting a lighter carrier into the slotted handle; and attaching the end cap cover to the end cap by utilizing a snap fit.

Figure 12A:
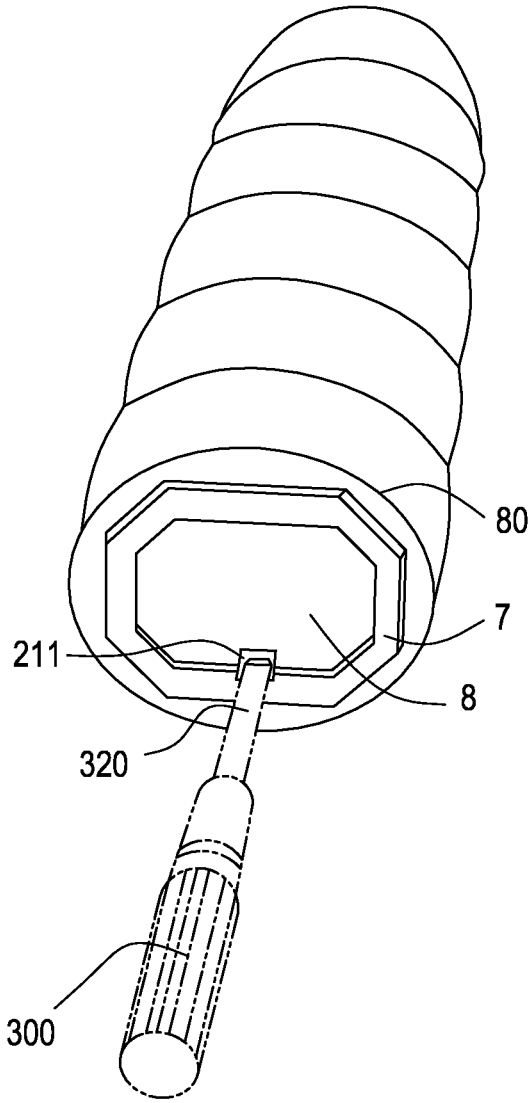
FIGS. 12*a*-12*d* display various steps for changing an exemplary removable weight cartridge within the exemplary handle of FIG. 11.
Figure 12B:
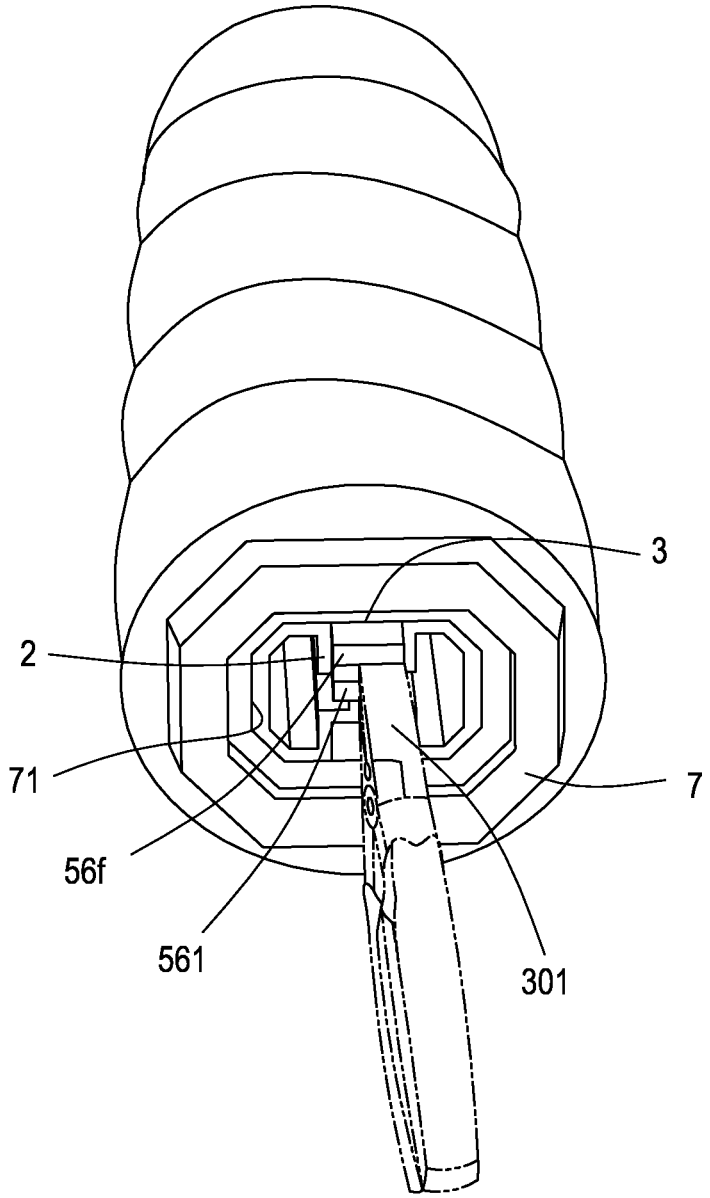

FIGS. 12*a*-12*d* display various steps for changing an exemplary removable weight cartridge within exemplary handle 80 of FIG. 11. As shown in FIG. 12*a*, the tip 320 of a screwdriver 300 may be inserted into opening 211 extending along an outer region of butt cap cover 8, and moved away from exemplary handle 80 so as to dislodge butt cap cover 8 from exemplary butt cap 7, and provide access to butt cap window 71. As shown in FIG. 12*b*, with butt cap cover 8 removed, butt cap window 71 provides access to exemplary removable weight cartridge 56*f* positioned within accessible slot 3 of exemplary handle 80.

As noted above and as shown in FIG. 12*b*, the design of exemplary butt cap 7, butt cap window 71, and butt cap cover 8 allow space for a given exemplary weight carrier (e.g., removable weight 56*f*) to extend beyond the terminus of the carbon fiber frame (i.e., beyond first grip butt end 2), for example, approximately ⅛ of an inch beyond first grip butt end 2. To dislodge removable weight 56*f*, needle nose pliers 301 may be used to grab protruding end 561 of removable weight 56*f*, and remove removable weight 56*f*.

Figure 12C:
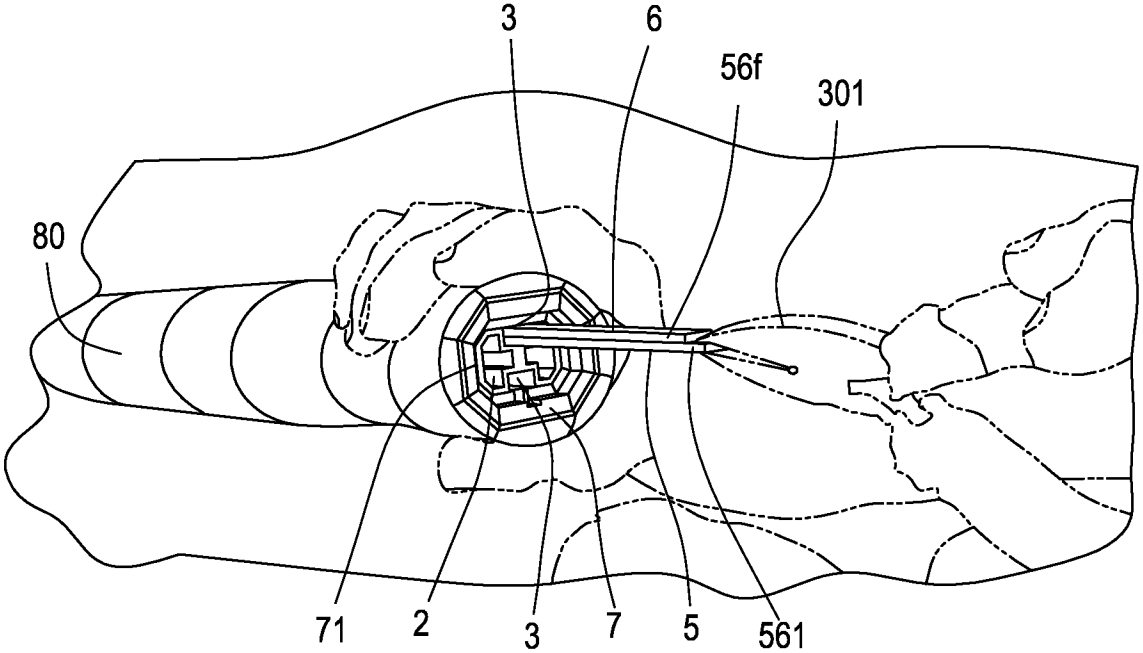
Figure 12D:
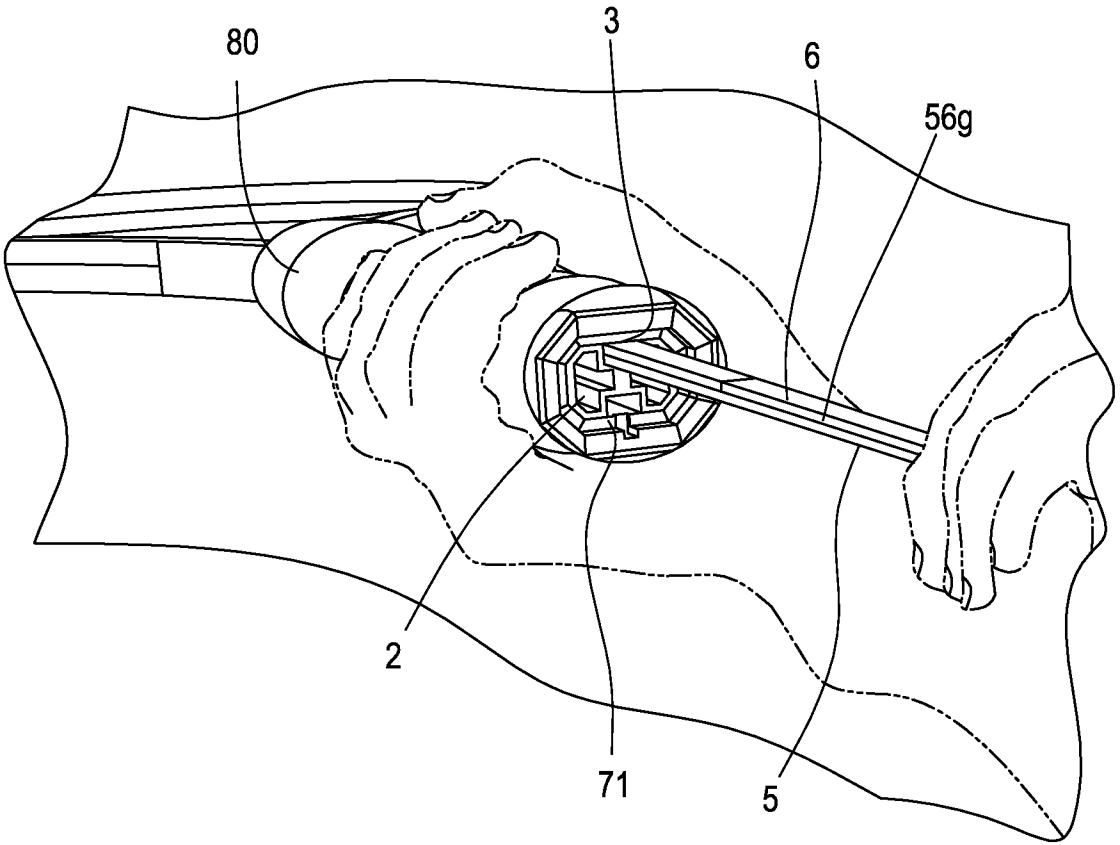

FIG. 12*c* provides a view of removable weight 56*f* (i.e., carrier 5 with individual weight 6 thereon) being removed from accessible slot 3 of exemplary handle 80 using needle nose pliers 301. Once removable weight 56*f* is removed, another removable weight 56*g* may be inserted into accessible slot 3 of exemplary handle 80 as shown in FIG. 12*d*. Once removable weight 56*g* is in place within accessible slot 3 of exemplary handle 80, butt cap cover 8 can be put into place as shown in FIG. 11.

The present invention enables specifications of a racket to be changed, such as the weight, the balance point, and the swing weight. Weight added to a racket can lead to increased inertia in a racket ball collision. Not only is the amount of weight added important, but how that weight is distributed is essential. The present invention makes accessible the normally inaccessible area of a given racket, namely, the racket handle, so that the weight and/or weight distribution along a complete length of the handle of the racket can be modified as desired. Once a player finds a desired weight and weight distribution along a length of a given racket handle, the player can permanently fix the selected handle weight with cement if so desired. Furthermore, once a player knows their ideal weight, balance, and swing weight, additional rackets can be matched or made identical to their standards utilizing the disclosed cartridge carrier system.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A racket comprising:

a racket handle having a first grip butt end, a second handle connecting end opposite said first grip butt end, and one or more side surfaces extending between and connecting said first grip butt and second handle connecting ends; and one or more accessible slots extending from said first grip butt end into said racket handle toward said second handle connecting end, each accessible slot (i) being sized and dimensioned so as to receive one or more removable weights, and (ii) having a slot length of up to a full length of the racket handle; wherein said one or more accessible slots comprises two accessible slots positioned opposite one another along a first end surface of said first grip butt end.

2. The racket of claim 1, wherein each of said one or more accessible slots extends at least 50% of a total distance between said first grip butt end and said second handle connecting end.

3. The racket of claim 2, wherein each of said one or more accessible slots extends at least 90% of a total distance between said first grip butt end and said handle connecting second end.

4. The racket of claim 1, further comprising at least one first end cover member sized to prevent one or more removable weights, when present within said one or more accessible slots, from exiting said one or more accessible slots.

5. The racket of claim 4, wherein said at least one first end cover member comprising a single first end cover member sized to prevent one or more removable weights, when present within said one or more accessible slots, from exiting said one or more accessible slots.

6. The racket of claim 1, wherein said racket handle further comprises a handle pallet positioned over at least a portion of said one or more side surfaces, said handle pallet comprising a single tubular piece or two or more tubular pieces that extend(s) around an outer perimeter of said racket handle.

7. The racket of claim 6, wherein said handle pallet comprising two tubular half pieces that extend around an outer perimeter of said racket handle.

8. The racket of claim 6, wherein said handle pallet comprises polyurethane foam.

9. The racket of claim 1, further comprising said one or more removable weights.

10. The racket of claim 9, wherein each of said one or more removable weights comprises a cartridge carrier and one or more individual weights positioned along said carrier.

11. The racket of claim 10, wherein said carrier comprises a carrier material having a carrier basis weight, and each of said one or more individual weights comprises a weight material having a higher basis weight than the carrier basis weight.

12. The racket of claim 11, wherein said carrier comprises basswood, and said one or more individual weights comprise lead tape.

13. The racket of claim 1, further comprising a throat attached to said second handle connecting end of said racket handle, and a head attached to said throat.

14. The racket of claim 13, wherein said racket handle, said throat, and said head combine with one another to form a tennis racket frame.

15. The racket of claim 14, wherein said frame comprising carbon fiber.

16. A racket comprising:

a racket handle having a first grip butt end, a second handle connecting end opposite said first grip butt end, and one or more side surfaces extending between and connecting said first grip butt and second handle connecting ends;

one or more accessible slots extending from said first grip butt end into said racket handle toward said second handle connecting end, each accessible slot (i) being sized and dimensioned so as to receive one or more removable weights, and (ii) having a slot length of up to a full length of the racket handle;

a head; and a throat connecting (i) said second handle connecting end of said racket handle and (ii) said head;

said racket in combination with one or more removable weights, wherein each of said one or more removable weights (i) comprises a carrier and one or more individual weights positioned along said carrier, (ii) is sized and dimensioned so as to securely fit within and extend along a given accessible slot, and (iii) has a removable weight length greater than the slot length.

17. The racket of claim 16, wherein each of said one or more accessible slots extends at least 50% of a total distance between said first grip butt end and said second handle connecting end.

18. The racket of claim 16, wherein said racket handle further comprises a handle pallet positioned over at least a portion of said one or more side surfaces, said handle pallet comprising a single tubular piece or two or more tubular pieces that extend(s) around an outer perimeter of said racket handle.

19. The racket of claim 16, wherein said racket handle further comprises a leather or synthetic grip material positioned to form at least a portion of an outer surface of said racket handle.

20. The racket of claim 16, wherein said one or more accessible slots comprises two accessible slots positioned opposite one another along a first end surface of said first grip butt end.

21. A racket comprising:

a racket handle having a first grip butt end, a second handle connecting end opposite said first grip butt end, and one or more side surfaces extending between and connecting said first grip butt and second handle connecting ends;

one or more accessible slots extending from said first grip butt end into said racket handle toward said second handle connecting end, each accessible slot (i) being sized and dimensioned so as to receive one or more removable weights, and (ii) having a slot length that extends at least 50% of a total distance between said first grip butt end and said second handle connecting end;

a single first end cover member sized to prevent one or more removable weights, when present within said one or more accessible slots, from exiting said one or more accessible slots;

a handle pallet positioned over and attached to at least a portion of said one or more side surfaces, said handle pallet comprising a single tubular piece or two or more tubular pieces that extend(s) around an outer perimeter of said racket handle;

a leather or synthetic grip material positioned over at least a portion of an outer surface of said handle pallet;

a head; and a throat connecting (i) said second handle connecting end of said racket handle and (ii) said head.

22. The racket of claim 21, wherein said one or more accessible slots comprises two accessible slots positioned opposite one another along a first end surface of said first grip butt end, and each of said two accessible slots extends at least 90% of a total distance between said first grip butt end and said second handle connecting end.

23. The racket of claim 21, in combination with one or more removable weights, wherein each of said one or more removable weights (i) comprises a carrier and one or more individual weights positioned along said carrier, (ii) is sized and dimensioned so as to securely fit within and extend along a given accessible slot, and (iii) has a removable weight length less than, substantially equal to, or slightly greater than the slot length.

24. The racket of claim 21, wherein said racket handle, said throat, and said head combine with one another to form a tennis racket frame.

* * * * *